US008176718B2

(12) United States Patent
Ridge et al.

(10) Patent No.: US 8,176,718 B2
(45) Date of Patent: May 15, 2012

(54) CABLE, COMBINED CABLE MADE OF PLASTIC FIBERS AND STEEL WIRE STRANDS, AND COMBINED STRANDS MADE OF PLASTIC FIBERS AND STEEL WIRES

(75) Inventors: Isabel Ridge, Didcot (GB); Nicholas O'Hear, Schoonhoven (NL); Otto Grabandt, Abcoude (NL); Cornelis Adrianus Das, Doetinchem (NL)

(73) Assignee: Casar Drahtseilwerk Saar GmbH, Kirkel (DE)

( * ) Notice: Subject to any disclaimer, the term of this patent is extended or adjusted under 35 U.S.C. 154(b) by 0 days.

(21) Appl. No.: 12/451,576

(22) PCT Filed: May 15, 2008

(86) PCT No.: PCT/DE2008/000834

§ 371 (c)(1),
(2), (4) Date: Nov. 18, 2009

(87) PCT Pub. No.: WO2008/141623

PCT Pub. Date: Nov. 27, 2008

(65) Prior Publication Data

US 2010/0071340 A1 Mar. 25, 2010

(30) Foreign Application Priority Data

May 18, 2007 (DE) ..... 10 2007 023 710
May 22, 2007 (DE) ..... 10 2007 024 020

(51) Int. Cl.
*D02G 3/48* (2006.01)

(52) U.S. Cl. ..... 57/212

(58) Field of Classification Search ..... 57/210, 57/212, 230; 87/6, 9
See application file for complete search history.

(56) References Cited

U.S. PATENT DOCUMENTS

| | | | | |
|---|---|---|---|---|
| 3,627,572 | A | 12/1971 | Barnett | |
| 4,887,422 | A | 12/1989 | Klees et al. | |
| 5,322,049 | A * | 6/1994 | Dunlap | 124/90 |
| 5,582,911 | A | 12/1996 | Meraldi et al. | |
| 5,979,288 | A * | 11/1999 | Gallagher et al. | 87/36 |
| 6,321,520 | B1 * | 11/2001 | De Angelis | 57/223 |
| 6,412,264 | B1 * | 7/2002 | De Josez et al. | 57/217 |
| 6,563,054 | B1 | 5/2003 | Damien et al. | |
| 2006/0137896 | A1 | 6/2006 | O'Donnell | |

FOREIGN PATENT DOCUMENTS

| | | |
|---|---|---|
| DE | 1 510 065 | 12/1969 |
| DE | 29 11 753 | 10/1980 |
| EP | 1 010 803 | 6/2000 |
| EP | 1 083 254 | 3/2001 |
| GB | 1 557 391 | 12/1979 |
| GB | 2 269 400 | 2/1994 |
| WO | 00/50687 | 8/2000 |

* cited by examiner

*Primary Examiner* — Shaun R Hurley
(74) *Attorney, Agent, or Firm* — Lucas & Mercanti, LLP; Klaus P. Stoffel

(57) ABSTRACT

A combined cable comprising a core cable of high-strength synthetic fibers, which take the form of a twisted bundle of monofilaments or a plurality of twisted bundles of monofilaments, and comprising an outer layer of steel wire strands, is characterized in that the bundle or bundles of monofilaments is or are stretched, with a reduction in diameter, and held in this state by a sheathing, in particular a braided sheathing. The extension under strain of the core cable under load is thereby reduced, so that the load distribution between the cross section of steel and the cross section of synthetic material of the cable improves.

11 Claims, 3 Drawing Sheets

Figure 1:
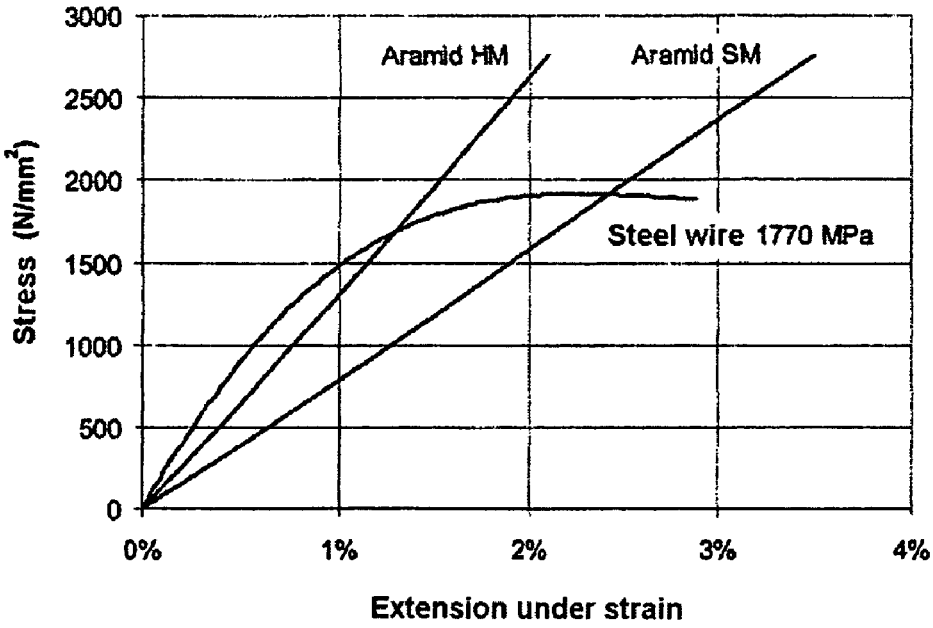

CABLE, COMBINED CABLE MADE OF PLASTIC FIBERS AND STEEL WIRE STRANDS, AND COMBINED STRANDS MADE OF PLASTIC FIBERS AND STEEL WIRES

The invention relates to a cable of high-strength-synthetic-fibers, which are present as bundles of monofilaments, in particular a twisted bundle of monofilaments, or a plurality of twisted bundles of monofilaments, which is or are enclosed by a sheathing.

In particular, the invention relates to a combined cable comprised of a core cable of high-strength synthetic fibers and an outer layer of steel wire strands.

The invention also relates to a combined strand having a core of high-strength synthetic fibers and an outer layer of steel wires.

Cables of the aforementioned type, with a braiding protecting the synthetic fibers, are known from use, in particular for sports purposes.

A combined cable of the aforementioned type is known from U.S. Pat. No. 4,887,422, with a sheathing of the core cable, which is extruded or wound on.

A combined strand of the aforementioned type is not state of the art.

An advantage of the high-strength synthetic fibers, both in the cables on their own and in the combined cables and strands, is their low weight and volume in comparison with their strength.

This advantage comes into effect in particular in the case of cables of great length for suspended use, such as hauling or hoisting cables in mining or deep-sea cables. This is because, during such use, the weight of a wire cable by itself already takes up a large part of its load-bearing capacity; the payload is correspondingly limited.

An advantage of the combined cable over the cable entirely of synthetic material is its much lower sensitivity to disturbing mechanical influences. Furthermore, the replacement state of wear of a wire cable can be onserved in good time from the visible wire breakages.

While the breaking strength of the high-strength synthetic fibers, for example aramid copolymer 3470 N/mm$^2$, aramid HM (high modulus) 2850 N/mm$^2$, aramid HS (high strength) 3350 N/mm$^2$, aramid SMS (standard modulus) 2850 N/mm$^2$, HMPE 3400 N/mm$^2$ and liquid-crystal polyester 2800 N/mm$^2$, exceeds that of steel wire, for example 1770 N/mm$^2$, and so in itself can contribute decisively to the load-bearing capacity of a combined cable, the elongations under strain differ however to such a degree that there is scarcely a cable construction among the known cable constructions in which the core cable of synthetic material can take a significant part in bearing the load. The moduli of elasticity of the fiber materials above are 73, 120, 60, 60, 85 and 65 GPa, respectively, as compared with an average of 200 GPa for steel wires. In addition to this in particular is the fact that the actual load bearing of the synthetic fibers is delayed, because, under any load, bundles of monofilaments first have to "settle", i.e. have to find a final spatial order, forming a stable bundle cross section.

The invention is based on the object of increasing the effective load-bearing capacity of a core cable of synthetic fibers in a combined cable and, in relation to the synthetic cable itself, of increasing the load-bearing capacity in another sense.

According to the invention, this purpose is achieved in the case of a cable of the type mentioned at the beginning by the bundle or bundles of monofilaments being stretched, with a reduction in diameter, and held in this state by the sheathing.

Acting like a corset, the sheathing fixes the cross section of the bundle of monofilaments assumed under the stretching mentioned. This at least largely eliminates the process of "settling" before and at the beginning of bearing loads, it is completed once and for all. The normal load bearing under elastic strain of the synthetic fibers in accordance with Hooke's law can begin immediately.

In a combined cable, the strain behavior of the core cable consequently approximates that of the steel wire layer. With the same load-bearing capacity, a cable on its own has, for example, a diameter reduced by 10%, i.e. a greater load-bearing capacity in relation to the diameter.

As a variant and a particularly advantageous development of the invention, it is proposed to make the strain behavior of the steel wire layer of a combined cable approximate that of the core cable of synthetic fibers by subjecting the steel wire layer to the reverse version of the measure of the invention affecting the core cable: it is to be capable of elongating under load and have a cross section that changes to make this possible.

The actual measure of the invention in this version resides in that the cable has an intermediate layer of an elastic synthetic material into which the wire strands are pressed while spaced apart from one another in such a way that the outer layer extends under load, and contracts radially.

The elastic resiliency of the intermediate layer and the spacing of the wire strands from one another allow the helical lines described by the strands to draw out in length while increasing their pitch, with a reduction in their diameter and accordingly the spacing of the strands.

As a result of the elasticity of the synthetic material, the process is reversible when the load is relieved, in other, words the desired effect is obtained with every new load-bearing instance.

The advantages of the first version and the reverse version of the invention can respectively be used on their own, but with great success together.

By analogy with the combined cable, a combined strand can be created. In place of the core wire of the strand, there is then a cable that is formed in a way similar to the core cable of the strand but correspondingly thin. (The designation "cable" means strands of bundles of monofilaments irrespective of the construction.)

Particularly suitable as the sheathing mentioned is a braiding. In a braiding machine, the bundles of monofilaments can be simply stretched by being driven at the output of the machine, for example by a pair of rollers, to make them continue in their advancement, and restrained at the input of the machine, for example by means of a braked pair of rollers, and the braiding can be performed under prestress. However, it is likewise conceivable for them to be wound around.

If appropriate, the stretching can also be brought about by the reduction in cross section.

The intermediate layer mentioned is generally extruded on, as commonly occurs in the prior art, if appropriate onto the sheathing mentioned. It would be difficult to combine the sheathing and the intermediate layer since the two of them serve different purposes, and accordingly must have different properties. The sheathing should be as non-compliant as possible, the intermediate layer should be soft. Foam plastic also comes into consideration for the intermediate layer. Suitable materials for the sheathing are, for example, polyester fibers; suitable materials for the intermediate layer are polyurethanes, polyesters, polyolefins and polyamides.

To be mentioned finally as a particularly advantageous use of a core cable according to the invention is a combined cable for suspended use over a great difference in height, in particular with a lower end rotationally fixed, in particular a hoisting cage cable, deep-sea cable or cable car cable, which is characterized by changing of the length of lay over the length of the cable, in such a way that the load-specific torque of the wire cable decreases upward.

A wire cable of this construction is known from DE 36 32 298, which is hereby incorporated in the disclosure content of the present application.

With the changing of the length of lay mentioned, twists within the cable structure that are caused by the weight of the cable, in particular further twistings of the layer of strands in the lower region of the cable, which would tend to shorten the cable there, and consequently act against the load bearing of the core cable, can be avoided.

The invention is to be explained in more detail below on the basis of examples.

Figure 2:
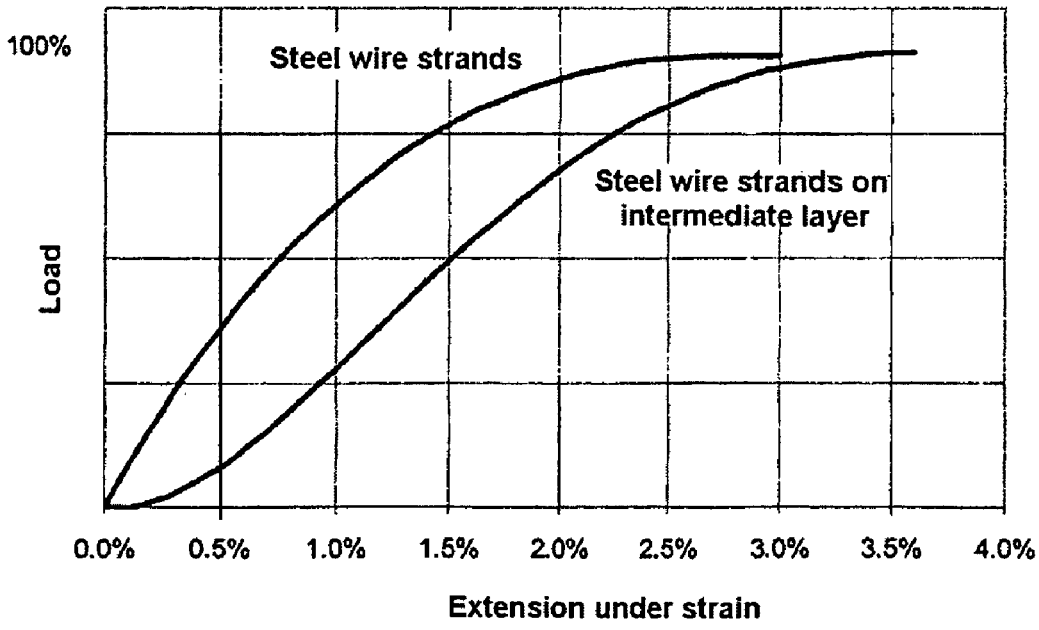
Figure 3:
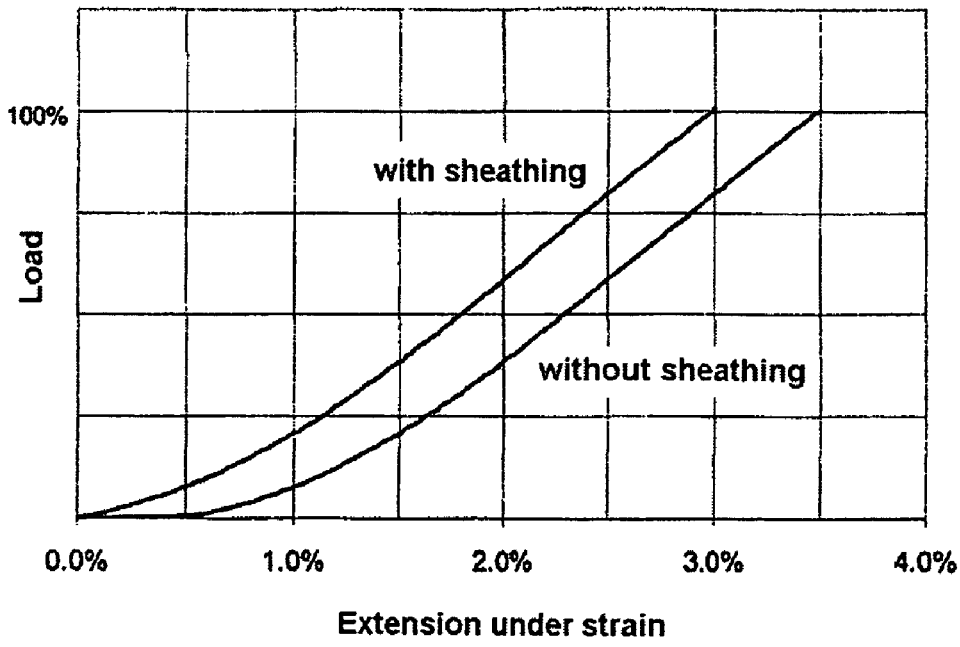
Figure 4:
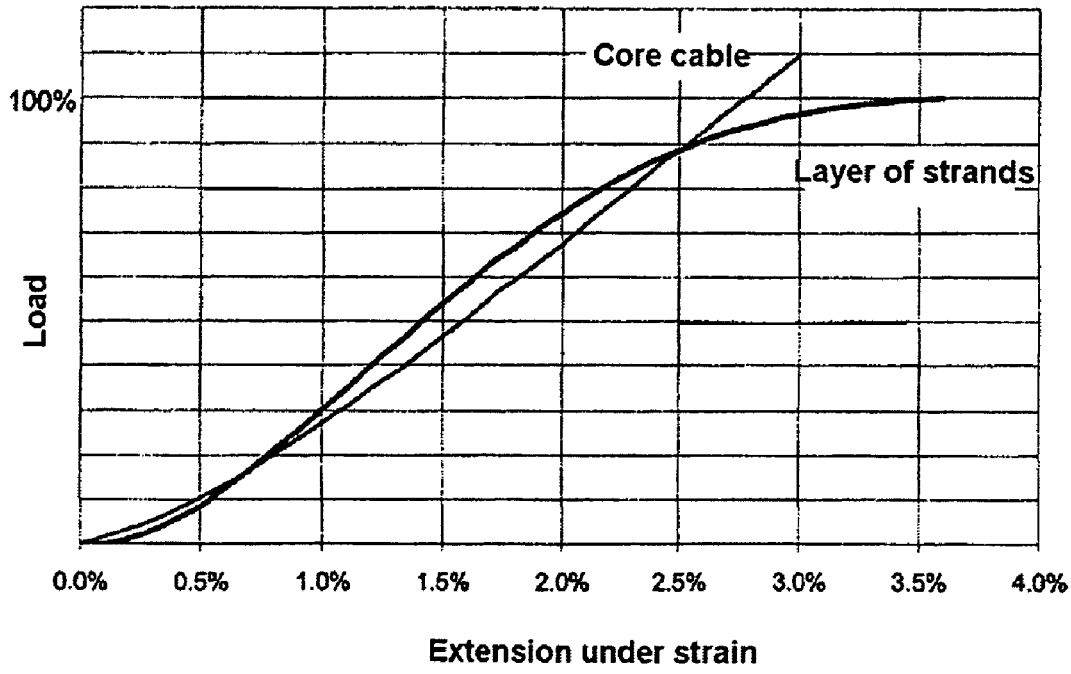
Figure 5:
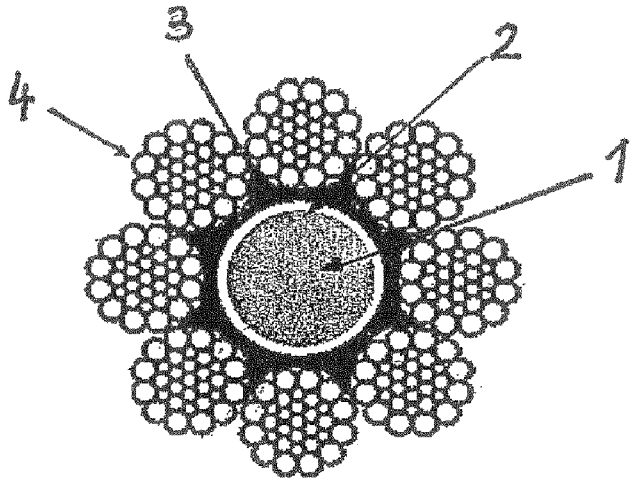
Figure 6:
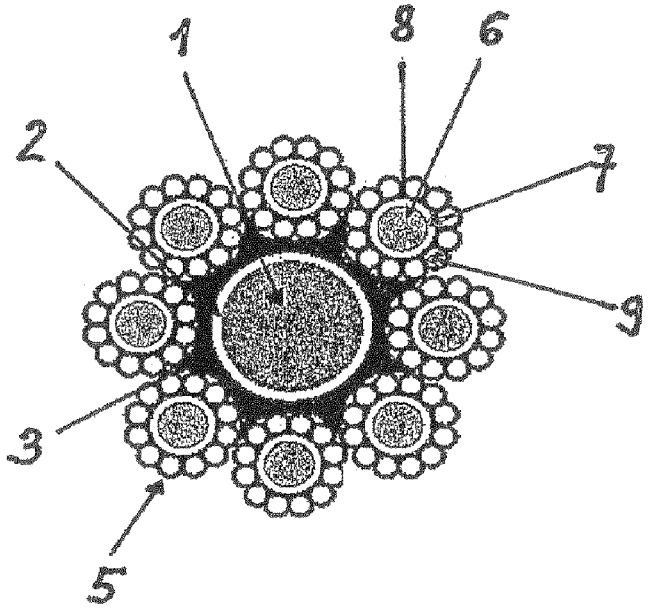

FIG. 1 shows a load-strain diagram for various materials,

FIG. 2 is a load-strain diagram of a normally stranded steel wire layer and a steel wire layer stranded on an elastic, soft intermediate layer according to the invention, FIG. 3 is a load-strain diagram of a core cable of synthetic fibers for a combined steel-wire/synthetic-fiber cable with and without sheathing according to the invention, FIG. 4 is a load-strain diagram of the core cable and the wire cable layer of a combined cable as shown in FIG. 5, FIG. 5 is a cross section of a combined cable with a core cable of synthetic fibers and an outer layer of steel wire strands and FIG. 6 is a cross section of a cable corresponding to FIG. 5 with different strands.

In FIG. 1, the materials concerned are respectively indicated right alongside the curves. The steel wire follows Hooke's law only in the lower load range, since it is produced by drawing and, as a consequence, does not have the normal structure. Use normally only takes place approximately in the lower half of the curves.

FIG. 2 gives the curve profile of the steel wire in FIG. 1 with the normally twisted layer of strands (upper curve). The lower curve shows the effect of the embedding of the strands in a soft intermediate layer according to the invention: up to an extension under strain of approximately 0.6%, the curve runs approximately horizontally. Here, the extension under strain comprises that the helical lines of the wound strands are drawn out in length while the diameter of the helical lines is reduced, virtually without bearing any load. The load bearing only begins subsequently.

As can be seen from FIG. 3, the aforementioned process of settling (lower curve), which is pronounced up to an extension under strain of 0.5% and then subsides, but is still noticeable up to an extension under strain of approximately 1%, can be largely eliminated by the sheathing according to the invention (upper curve). By contrast with the lower curve, the upper curve rises from the beginning, even though the final proportionate rise in accordance with Hooke's law only commences approximately between an extension under strain of 0.5 and an extension under strain of 1%.

The use of both measures of the invention in a combined cable, as shown in FIG. 5, can be seen from FIG. 4. Here, the lower curve of FIG. 2 and the upper curve of FIG. 3 lie close together.

In the cross section of the cable construction of FIG. 5, the measures of the invention can only be seen to the extent that it shows a sheathing 2 of a core cable 1 and also an intermediate layer 3, into which an outer layer of steel wire strands 4 is pressed.

Within the sheathing 2, the core cable 1 comprises a bundle of monofilaments or a number of bundles of monofilaments, which are in each case only twisted to the extent that they stay together and can be handled. The sheathing 2 comprises a braiding of preferably polyester filaments. It sits under prestress on the bundle or bundles of monofilaments, which after an extension under strain keeps them together in the settled state.

The intermediate layer 3 is extruded over the sheathing 2 of the core cable 1 in a way known per se. It consists of a soft-elastic synthetic material, for example polyethylene or polypropylene.

The steel wire strands 4 are twisted over that and have been pressed, for example, into the still warm intermediate layer 3 in such a way that, spaced apart from one another, they each have their own bed.

The intermediate layer 3 is so elastic-soft and the steel wire strands 4 have such a spacing from one another (somewhat greater than in the drawing) that the layer of steel wire strands 4 initially lengthens somewhat under load, and its diameter is reduced. The strain curves (FIG. 4) of the layer of strands and of the core cable are made to approach one another as a result, i.e. the load bearing is shared approximately in accordance with the cross sections of the layer of strands and the core cable.

The cable according to FIG. 6 has the same basic construction as that according to FIG. 5, comprising a core cable 1, a braided sheathing 2, an extruded-on intermediate layer 3 and an outer layer of strands, designated here by 5. The strands 5 have a construction analogous to the cable, once again with a, thinner, core cable 6 of high-strength synthetic fibers, a braided sheathing 7, an extruded-on intermediate layer 8 of a soft-elastic synthetic material and an outer layer of steel wires 9. On account of its greater cross section of synthetic material, the cable has the advantage of still lower weight, but at the same time, with the steel wires in the outer layer, is likewise robust.

The intermediate layer 3 could also be omitted in the case of this cable, since the outer strands 5 already themselves have increased extensibility.

The invention claimed is:

1. A combined cable comprising a core cable (1, 2) of high strength synthetic fibers and an outer layer of steel wire strands (4, 5), wherein the synthetic fibers are a bundle or a plurality of bundles of monofilaments, which is or are enclosed by a sheathing, wherein the bundle or bundles of monofilaments (1, 6) is or are stretched, with a reduction in diameter, so that the monofilaments are in a final spatial order, forming a stable cross section, wherein the sheathing sits, in a corset-like manner, under prestress on the bundle or the bundles so that the cross section of the bundle or bundles of monofilaments assumed in the stretched state is fixed.

2. The combined cable as claimed in claim 1, wherein the combined, cable is a cable for suspended use over a great difference in height, which is characterized by changing of the length of lay over the length of the cable, in such a way that the load-specific torque of the wire cable decreases upward.

3. The combined cable as claimed in claim 1, wherein the fibers are present as a twisted bundle of monofilaments or as a plurality of twisted bundles of monofilaments.

4. The combined cable as claimed in claim 1, wherein the sheathing (2) is braided.

5. A combined strand comprising a core (6, 7) of high strength synthetic fibers and an outer layer of steel wires (9), wherein the synthetic fibers are a bundle or a plurality of bundles of monofilaments, which is or are enclosed by a sheathing, wherein the bundle or bundles of monofilaments (1, 6) is or are stretched, with a reduction in diameter, so that the monofilaments are in a final spatial order, forming a stable cross section, wherein the sheathing sits, in a corset-like manner, under prestress on the bundle or the bundles so that the cross section of the bundle or bundles of monofilaments assumed in the stretched state is fixed.

6. The combined strand as claimed in claim 5, wherein the fibers are present as a twisted bundle of monofilaments or as a plurality of twisted bundles of monofilaments.

7. The combined strand as claimed in claim 5, wherein the sheathing (2) is braided.

8. A combined cable comprising a core cable (1, 2) of high-strength synthetic fibers and an outer layer of steel wire strands (4; 5), wherein the synthetic fibers are a bundle or a plurality of bundles of monofilaments, which is or are stretched, with a reduction of diameter, so that the monofilaments form a stable bundle cross section, and are enclosed by an incompliant sheathing that fixes, in a corset-like manner, the cross section of the bundle or bundles of monofilaments assumed in the stretched state and, in addition to the sheathing, the combined cable has an intermediate layer (3) of an elastic synthetic material into which the steel wire strands (4; 5) are pressed while spaced apart from one another in such a way that the outer layer extends under load, and contracts radially in order to make strain behavior of the outer layer of steel wire strands approximate strain behavior of the core cable.

9. The combined cable as claimed in claim 8, wherein the intermediate layer (3; 8) is extruded on.

10. A combined strand comprising a core (6, 7) of high-strength synthetic fibers and an outer layer of steel wires (9), wherein the synthetic fibers are a bundle or a plurality of bundles of monofilaments, which is or are stretched, with a reduction of diameter, so that the monofilaments form a stable bundle cross section, and are enclosed by an incompliant sheathing that fixes, in a corset-like manner, the cross section of the bundle or bundles of monofilaments assumed in the stretched state and, in addition to the sheathing, the combined strand has an intermediate layer (8) of an elastic synthetic material into which the steel wires (9) are pressed while spaced apart from one another in such a way that the outer layer extends under load, and contracts radially in order to make strain behavior of the outer layer of steel wire strands approximate strain behavior of the core cable.

11. The combined strand as claimed in claim 10, wherein the outer strand (5) is a combined cable, which has a core cable (1) of high-strength synthetic fibers and an outer layer of strands.

* * * * *